US012414598B2

(12) United States Patent
Lee et al.

(10) Patent No.: US 12,414,598 B2
(45) Date of Patent: Sep. 16, 2025

(54) CHIN GUARD PIVOTING MECHANISM

(71) Applicant: HJC CORP., Gyeonggi-do (KR)

(72) Inventors: Jin Hwan Lee, Gyeonggi-do (KR); Ki Young Nam, Seoul (KR)

(73) Assignee: HJC CORP., Gyeonggi-do (KR)

( * ) Notice: Subject to any disclaimer, the term of this patent is extended or adjusted under 35 U.S.C. 154(b) by 112 days.

(21) Appl. No.: 18/263,912

(22) PCT Filed: Nov. 22, 2021

(86) PCT No.: PCT/KR2021/017166
§ 371 (c)(1),
(2) Date: Aug. 2, 2023

(87) PCT Pub. No.: WO2022/173097
PCT Pub. Date: Aug. 18, 2022

(65) Prior Publication Data

US 2024/0081463 A1 Mar. 14, 2024

(30) Foreign Application Priority Data

Feb. 9, 2021 (KR) ..... 10-2021-0018412

(51) Int. Cl.
*A42B 3/32* (2006.01)
*A42B 3/22* (2006.01)

(52) U.S. Cl.
CPC ..... *A42B 3/326* (2013.01); *A42B 3/222* (2013.01)

(58) Field of Classification Search
CPC ..... A42B 3/205; A42B 3/04; A42B 3/222; A42B 3/223; A42B 3/326
See application file for complete search history.

(56) References Cited

U.S. PATENT DOCUMENTS

2002/0129440 A1* 9/2002 Hong ..... A42B 3/326 2/422
2008/0196148 A1* 8/2008 Morin ..... A42B 3/222 2/10

(Continued)

FOREIGN PATENT DOCUMENTS

EP 0797935 A1 * 10/1997
EP 3001919 A1 * 4/2016 ..... A42B 3/223

(Continued)

*Primary Examiner* — Heather Mangine
(74) *Attorney, Agent, or Firm* — DUANE MORRIS LLP; Gregory M. Lefkowitz

(57) ABSTRACT

The present disclosure relates to a chin guard pivoting mechanism, and the chin guard pivoting mechanism (100) according to the present disclosure is provided in a helmet which comprises a helmet body (10), a chin guard (20) pivotally coupled to the helmet body (10), and a shield (30) pivotally coupled to the helmet body (10). When the chin guard (20) is pivoted from the front of a user's chin up to a first predetermined angle (A) with respect to the helmet body (10), the shield (30) is pivoted upward, and when the chin guard (20) is pivoted up to a second predetermined angle (B) greater than the first predetermined angle (A) with respect to the helmet body (10), the shield (30) is pivoted downward. Alternatively, when the chin guard (20) is pivoted from the front of a user's chin up to the first predetermined angle (A) with respect to the helmet body (10), the shield 30) is pivoted upward, and when the shield (30) is pivoted downward, the chin guard (20) is pivoted up to the second predetermined angle (B) with respect to the helmet body (10).

12 Claims, 8 Drawing Sheets

(56) References Cited

U.S. PATENT DOCUMENTS

| | | | | | |
|---|---|---|---|---|---|
| 2009/0100576 | A1* | 4/2009 | Kim | A42B 3/326 | 2/9 |
| 2011/0302701 | A1* | 12/2011 | Kuo | A42B 3/326 | 2/424 |
| 2012/0284906 | A1* | 11/2012 | Kuo | A42B 3/223 | 2/424 |
| 2013/0340148 | A1* | 12/2013 | Arai | A42B 3/326 | 2/421 |
| 2018/0213877 | A1* | 8/2018 | Liao | A42B 3/225 | |
| 2020/0178639 | A1* | 6/2020 | Jwa | A42B 3/205 | |
| 2021/0274877 | A1* | 9/2021 | Liao | A42B 3/205 | |
| 2024/0081463 | A1* | 3/2024 | Lee | A42B 3/326 | |
| 2024/0180282 | A1* | 6/2024 | Lee | A42B 3/223 | |

FOREIGN PATENT DOCUMENTS

| | | | | | |
|---|---|---|---|---|---|
| KR | 20220143270 | A | * | 10/2022 | |
| WO | WO-2006128833 | A1 | * | 12/2006 | A42B 3/222 |

* cited by examiner

CHIN GUARD PIVOTING MECHANISM

CROSS-REFERENCE TO RELATED APPLICATIONS

This application is a § 371 national stage entry of International Application No. PCT/KR2021/017166, filed on Nov. 22, 2021, which claims priority to Korean Patent Application No. 10-2021-0018412, filed on Feb. 9, 2021, the entire contents of which are incorporated herein by reference.

TECHNICAL FIELD

The present disclosure relates to a chin guard pivoting mechanism.

BACKGROUND

In general, it is mandatory to wear a helmet while driving a two wheeled vehicle with high speed to protect the wearer's head. The helmet has a front open portion to ensure the wearer's frontal field of view. Additionally, the helmet may include a shield that can selectively open and close the open portion to keep out wind, dust, etc. while driving.

Meanwhile, the helmet according to the prior art includes a chin guard to protect the wearer's chin as disclosed by the patent literature of the related literatures as described below.

RELATED LITERATURES

Patent Literature (Patent Literature 1) KR10-2014-0001141 A

SUMMARY

An aspect of the present disclosure is directed to a chin guard pivoting mechanism for pivoting a chin guard and a shield in tandem.

A chin guard pivoting mechanism according to an embodiment of the present disclosure is provided in a helmet including a helmet body, a chin guard pivotally coupled to the helmet body and a shield pivotally coupled to the helmet body, and upon pivoting of the chin guard from a front side of a wearer's chin to a first predetermined angle with respect to the helmet body, the shield pivots upward, and upon pivoting of the chin guard to a second predetermined angle which is larger than the first predetermined angle with respect to the helmet body, the shield pivots downward, or upon pivoting of the chin guard from the front side of the wearer's chin to the first predetermined angle with respect to the helmet body, the shield pivots upward, and upon downward pivoting of the shield, the chin guard pivots to the second predetermined angle with respect to the helmet body.

Additionally, in the chin guard pivoting mechanism according to an embodiment of the present disclosure, upon pivoting of the chin guard from the first predetermined angle to a third predetermined angle between the first predetermined angle and the second predetermined angle with respect to the helmet body, the shield does not pivot.

Additionally, in the chin guard pivoting mechanism according to an embodiment of the present disclosure, the chin guard pivoting mechanism includes a link having one side coupled to the chin guard, and an arm which pivots the shield at one side, and the link and the arm pivot in tandem.

Additionally, in the chin guard pivoting mechanism according to an embodiment of the present disclosure, the link includes a first link and a second link, the chin guard is coupled to one side of the first link and one side of the second link, and the other side of the first link pivots around a first rotation axis, and the other side of the second link pivots around a second rotation axis.

Additionally, in the chin guard pivoting mechanism according to an embodiment of the present disclosure, upon pivoting of the chin guard from the front side of the wearer's chin with respect to the helmet body, one side of the first link is disposed in front of one side of the second link, then disposed above one side of the second link, and subsequently disposed at rear of one side of the second link.

Additionally, in the chin guard pivoting mechanism according to an embodiment of the present disclosure, the arm has a sliding portion along a lengthwise direction, and upon the pivoting of the chin guard, a coupling portion of the first link is slidable along the sliding portion.

Additionally, in the chin guard pivoting mechanism according to an embodiment of the present disclosure, the sliding portion includes a first sliding portion extended in an arc shape, and a second sliding portion extended from an end of the first sliding portion in an arc shape.

Additionally, in the chin guard pivoting mechanism according to an embodiment of the present disclosure, upon the upward pivoting of the shield with the pivoting of the chin guard from the front side of the wearer's chin to the first predetermined angle with respect to the helmet body, the coupling portion slides along the first sliding portion, and upon the downward pivoting of the shield with the pivoting of the chin guard to the second predetermined angle with respect to the helmet body, or upon the pivoting of the chin guard to the second predetermined angle with respect to the helmet body with the downward pivoting of the shield, the coupling portion slides along the first sliding portion.

Additionally, in the chin guard pivoting mechanism according to an embodiment of the present disclosure, upon pivoting of the chin guard from the first predetermined angle to a third predetermined angle between the first predetermined angle and the second predetermined angle with respect to the helmet body, and not pivoting of the shield, the coupling portion slides along the second sliding portion.

Additionally, in the chin guard pivoting mechanism according to an embodiment of the present disclosure, a radius of curvature of the second sliding portion corresponds to a distance between the coupling portion and the first rotation axis.

Additionally, in the chin guard pivoting mechanism according to an embodiment of the present disclosure, the arm is provided with the other side, which is configured to slide along a pivoting portion extended in an arc shape, such that the arm rotates as the other side slides in the pivoting portion.

Additionally, the chin guard pivoting mechanism according to an embodiment of the present disclosure includes a fastening portion which is coupled to the link, and is separated from the link upon the pivoting of the chin guard with respect to the helmet body.

Additionally, in the chin guard pivoting mechanism according to an embodiment of the present disclosure, a first hook portion of the fastening portion is fastened to a second hook portion of the link, and upon the pivoting of the chin guard with respect to the helmet body, the link pivots and accordingly the fastening portion pivots, and the first hook portion is separated from the second hook portion.

Additionally, in the chin guard pivoting mechanism according to an embodiment of the present disclosure, an elastic force is applied to the fastening portion in a direction in which the first hook portion is fastened to the second hook portion.

The features and advantages of the present disclosure will be apparent from the following detailed description in accordance with the accompanying drawings.

Prior to the description, it should be understood that the terms or words used in the specification and the appended claims should not be construed as limited to general and dictionary meanings, but rather interpreted based on the meanings and concepts corresponding to the technical spirit of the present disclosure on the basis of the principle that the inventor is allowed to define terms appropriately for the best explanation.

According to the present disclosure, since the chin guard and the shield pivot in tandem, when the chin guard pivots, the shield pivots, so it is easy for the wearer to wear the helmet.

In addition, according to the present disclosure, since the chin guard and the shield pivot in tandem, when the chin guard is disposed above and the shield pivots downward, the chin guard may automatically pivot to the rear side of the helmet body.

DETAILED DESCRIPTION

The objectives, particular advantages and new features of the present disclosure will be apparent from the following detailed description and exemplary embodiments in association with the accompanying drawings. In affixing the reference numbers to the elements of each drawing in the present disclosure, it should be noted that identical elements are given as identical numbers as possible although they are depicted in different drawings. Additionally, the terms such as "first", "second" or the like are used to distinguish one element from another, and the elements are not limited by the terms. Hereinafter, in describing the present disclosure, when it is determined that a certain description of related known technology may unnecessarily obscure the subject matter of the present disclosure, the detailed description is omitted.

Hereinafter, exemplary embodiments of the present disclosure will be described in detail with reference to the accompanying drawings.

Figure 1:
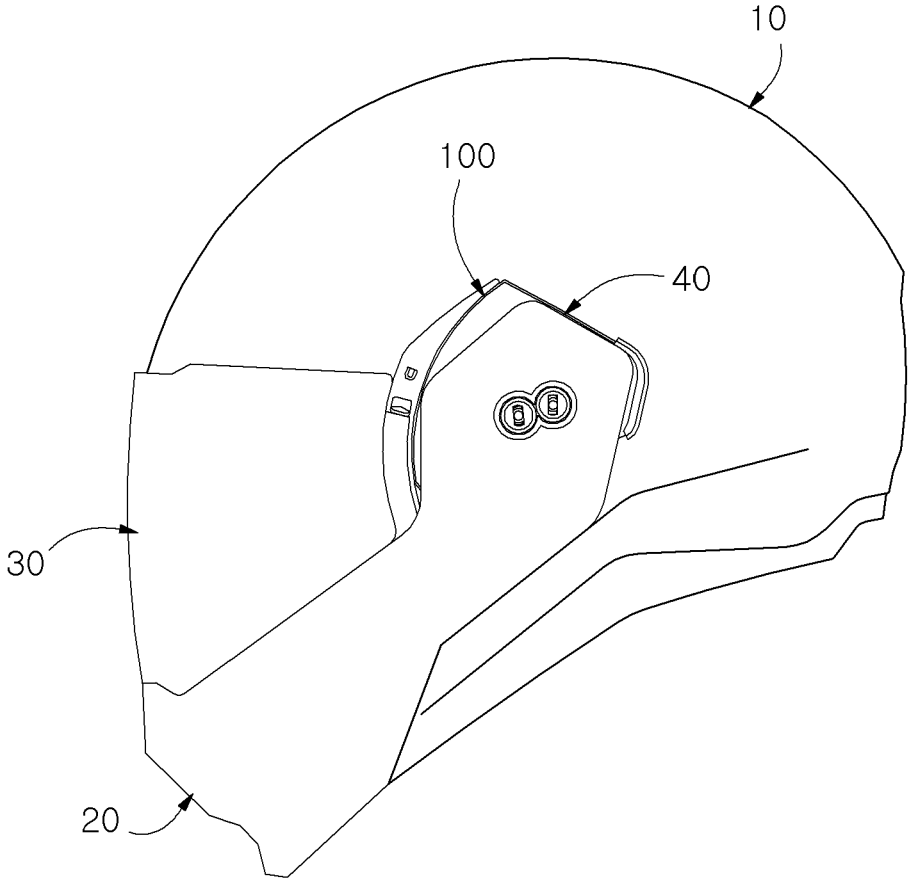
FIG. 1 is a side view of a helmet including a chin guard pivoting mechanism according to an embodiment of the present disclosure.
Figure 2:
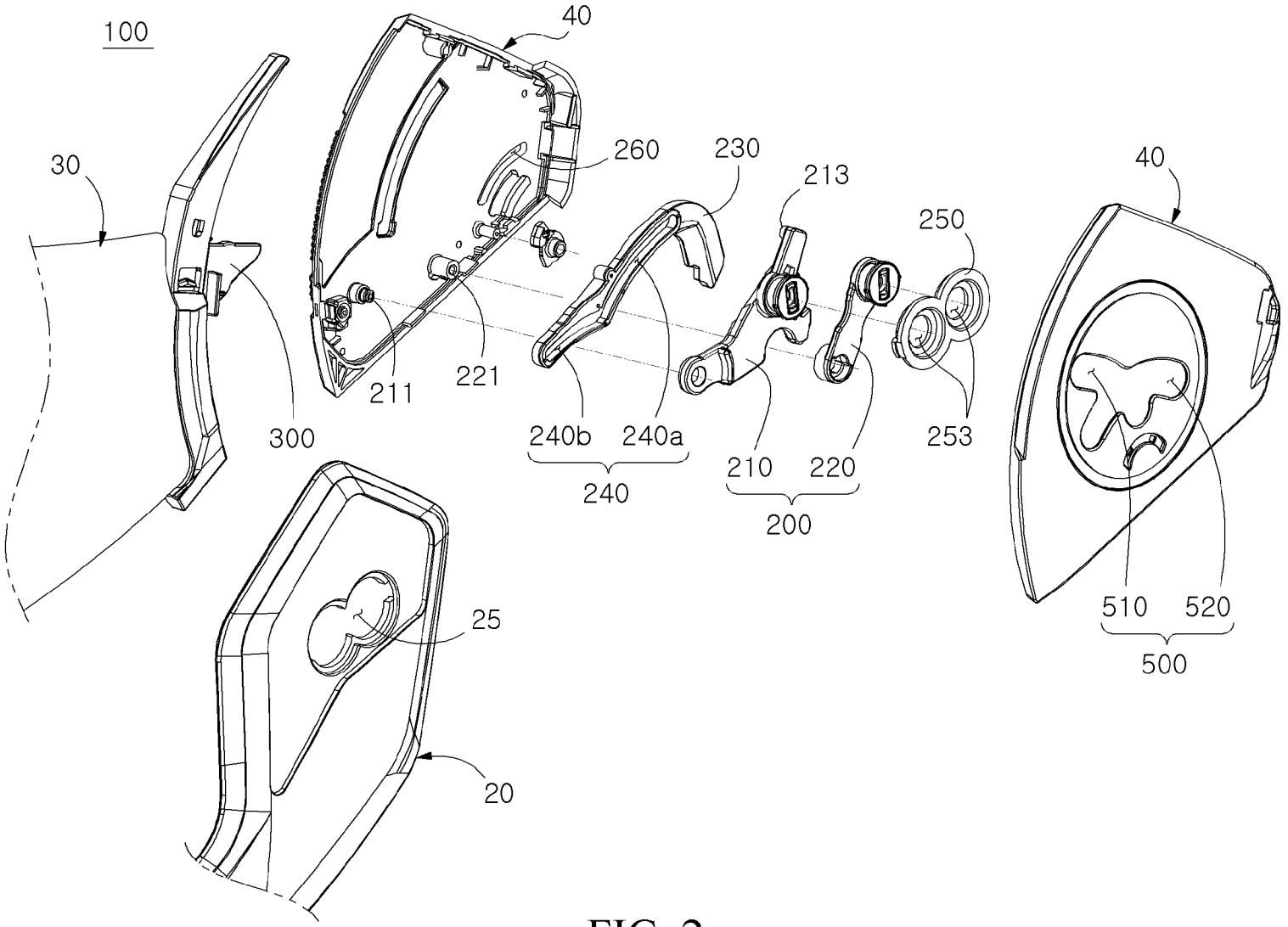
FIG. 2 is an exploded perspective view of a chin guard pivoting mechanism according to an embodiment of the present disclosure.

FIG. 1 is a side view of a helmet including a chin guard pivoting mechanism according to an embodiment of the present disclosure, and FIG. 2 is an exploded perspective view of the chin guard pivoting mechanism according to an embodiment of the present disclosure.

As shown in FIGS. 1 and 2, the chin guard pivoting mechanism 100 according to this embodiment is provided in a helmet including a helmet body 10, a chin guard 20 pivotably coupled to the helmet body 10 and a shield 30 pivotably coupled to the helmet body 10, and when the chin guard 20 pivots from the front side of a wearer's chin to a first predetermined angle with respect to the helmet body 10, the shield 30 pivots upward, and when the chin guard 20 pivots to a second predetermined angle that is larger than the first predetermined angle with respect to the helmet body 10, the shield pivots downward, or when the chin guard 20 pivots from the front side of the wearer's chin to the first predetermined angle with respect to the helmet body 10, the shield 30 pivots upward, and when the shield 30 pivots downward, the chin guard 20 pivots to the second predetermined angle with respect to the helmet body 10.

Basically, the helmet body 10 plays a role in protecting the wearer's head. The helmet body 10 may be made of a shock absorbing material. For example, the helmet body 10 may include an outer shell of hard synthetic resin and having high strength, and an absorber disposed in the outer shell, made of an expanded polystyrene (EPS) foam and having proper strength and elasticity. A pad may be present inside the absorber to improve a snug fit.

Figure 3A:
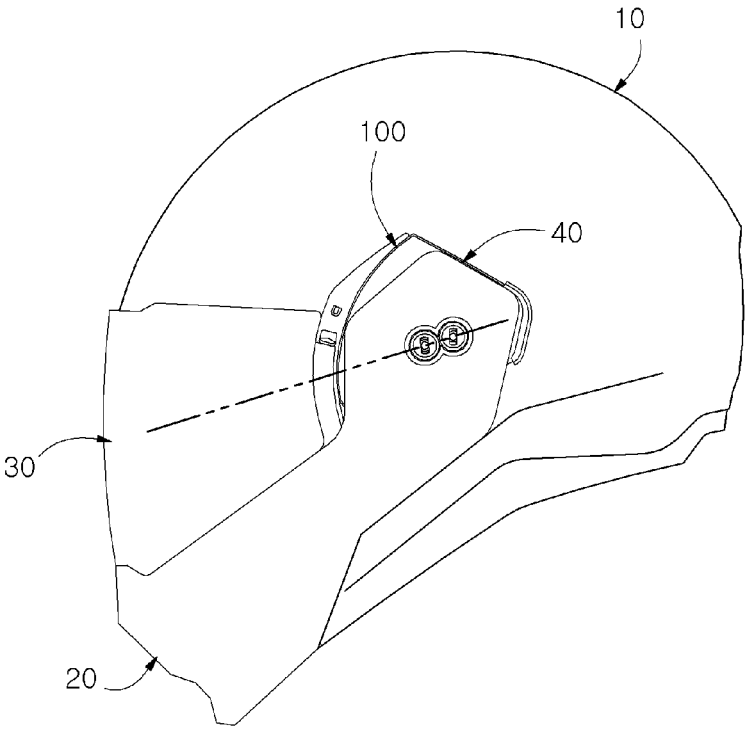
FIGS. 3 to 7 are side views showing an operation process of a helmet including a chin guard pivoting mechanism according to an embodiment of the present disclosure and an operation process of the chin guard pivoting mechanism.
Figure 3B:
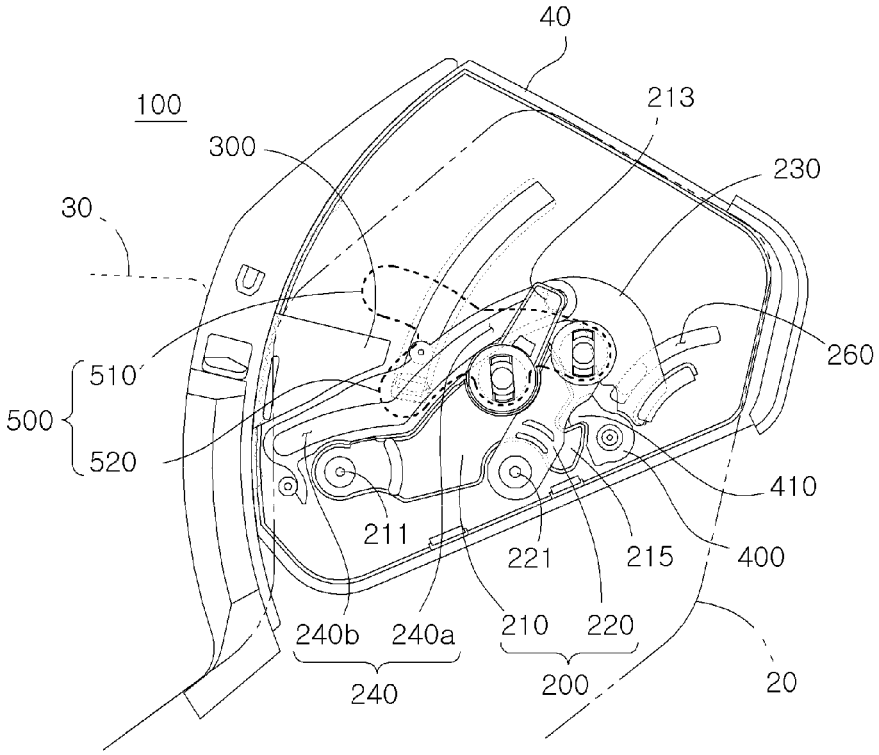
Figure 6A:
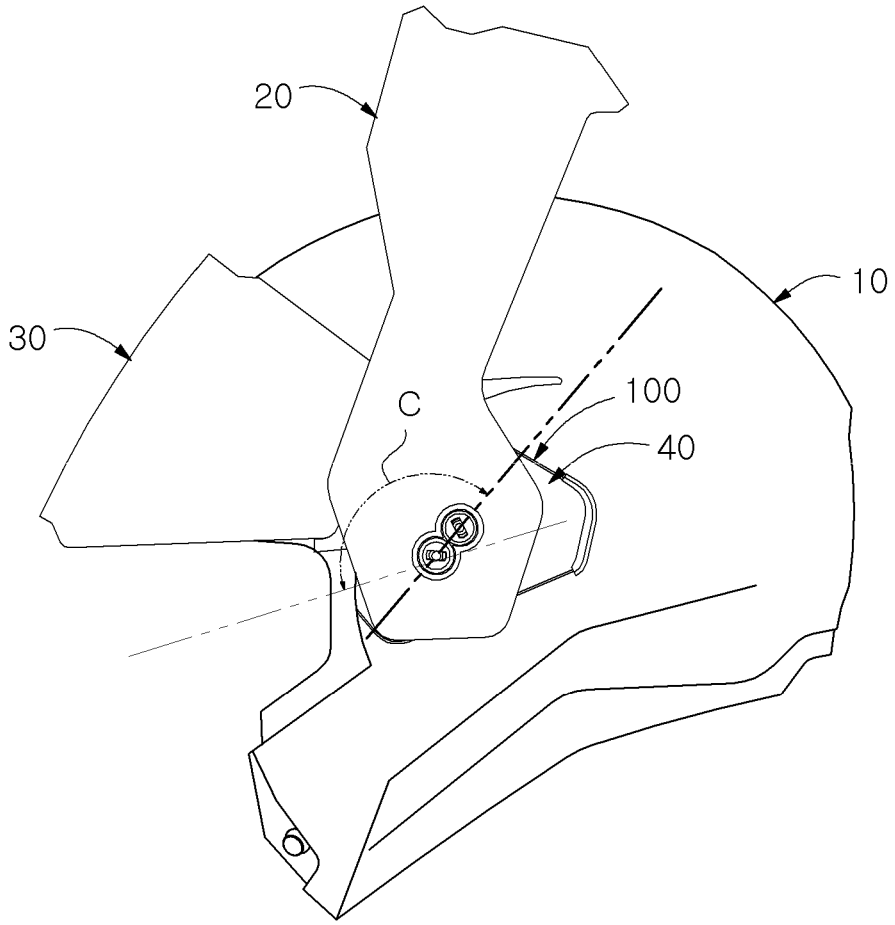

Additionally, the chin guard 20 plays a role in protecting the wearer's chin, and may be extended in an arc shape as a whole so that it is disposed in front of the wearer's chin. In this instance, the chin guard 20 is, at two ends, rotatably coupled to two sides (for example, a ratchet 40) of the helmet body 10, and is pivotable from a first predetermined position to a third predetermined position. For example, the first predetermined position may refer to a position (Full Face Mode) when the chin guard 20 is disposed in front of the wearer's chin (see FIG. 3A), the second predetermined position may refer to a position (Wearing Mode) when the chin guard 20 is disposed above the helmet body 10 (see FIG. 6A), and the third predetermined position may refer to a position (Open Face Mode) when the chin guard 20 is disposed at the rear of the helmet body 10 (see FIG. 7A).

Figure 4A:
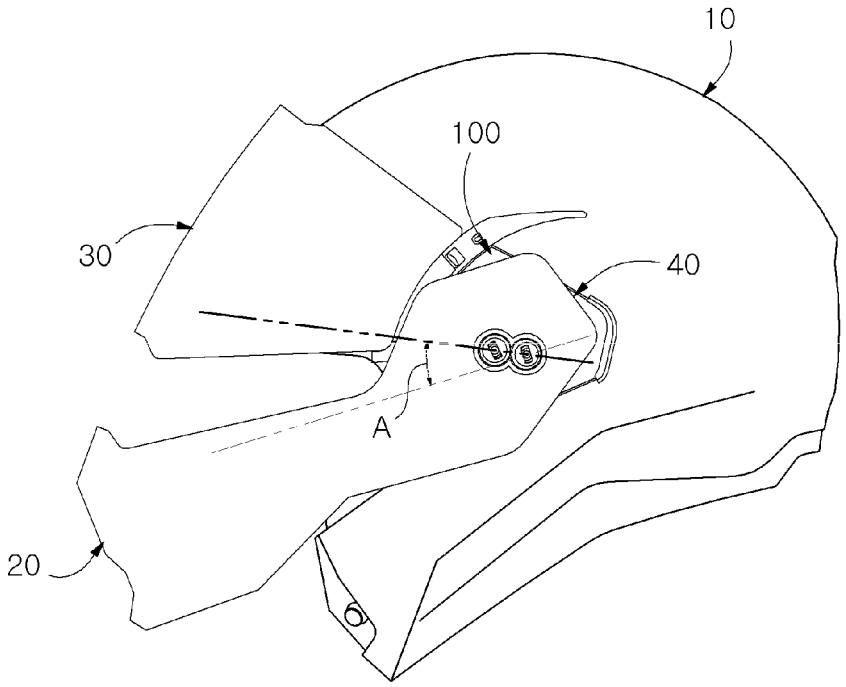
Figure 4B:
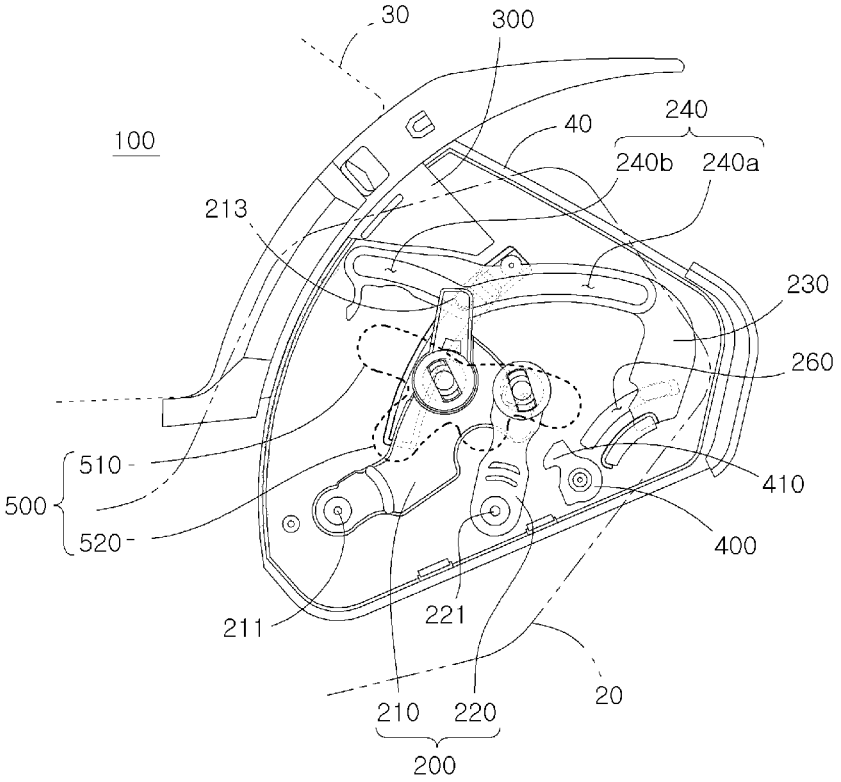

Additionally, the shield 30 plays a role in opening and closing a front open portion of the helmet body 10, and is pivotably coupled to the two sides (for example, the ratchet 40) of the helmet body 10, so that the shield 30 is rotatable around the helmet body 10 and pivotable from a first position to a second position. For example, the first position may refer to a position in which the shield 30 closes the open portion (see FIG. 3A), and the second position may refer to a position in which the shield 30 opens the open portion (see FIG. 4A).

The chin guard 20 and the shield 30 pivot in tandem by the chin guard pivoting mechanism 100 according to this embodiment, and hereinafter, the chin guard pivoting mechanism 100 will be described in detail.

As shown in FIGS. 3A to 4A, when the chin guard 20 pivots from the front side of the wearer's chin to the first predetermined angle A with respect to the helmet body 10, the shield 30 may also pivot upward and the open portion may be opened. That is, when the chin guard 20 pivots by the first predetermined angle A from the first predetermined position (Full Face Mode), the shield 30 may pivot from the first position (the closed position of the open portion) to the second position (the open position of the open portion). In this instance, the first predetermined angle A of the chin guard 20 is not limited to a particular angle, but may be, for example, between 15° and 35°.

Subsequently, as shown in FIGS. 5A to 6A, when the chin guard 20 pivots from the first predetermined angle A to a third predetermined angle C that is larger than the first predetermined angle A with respect to the helmet body 10, the shield 30 may stay in place, not pivoting. That is, while the chin guard 20 pivots to the second predetermined position (Wearing Mode), the shield 30 may be kept in the second position (the open position of the open portion). In this instance, the third predetermined angle C of the chin guard 20 is not limited to a particular angle, but may be, for example, between 140° and 160°.

Figure 7A:
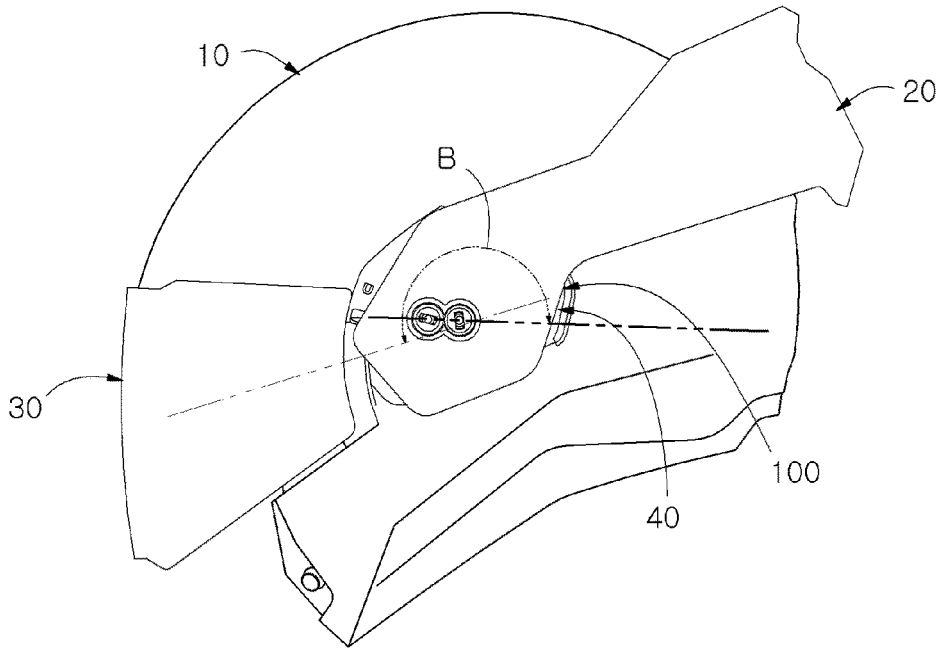
Figure 7B:
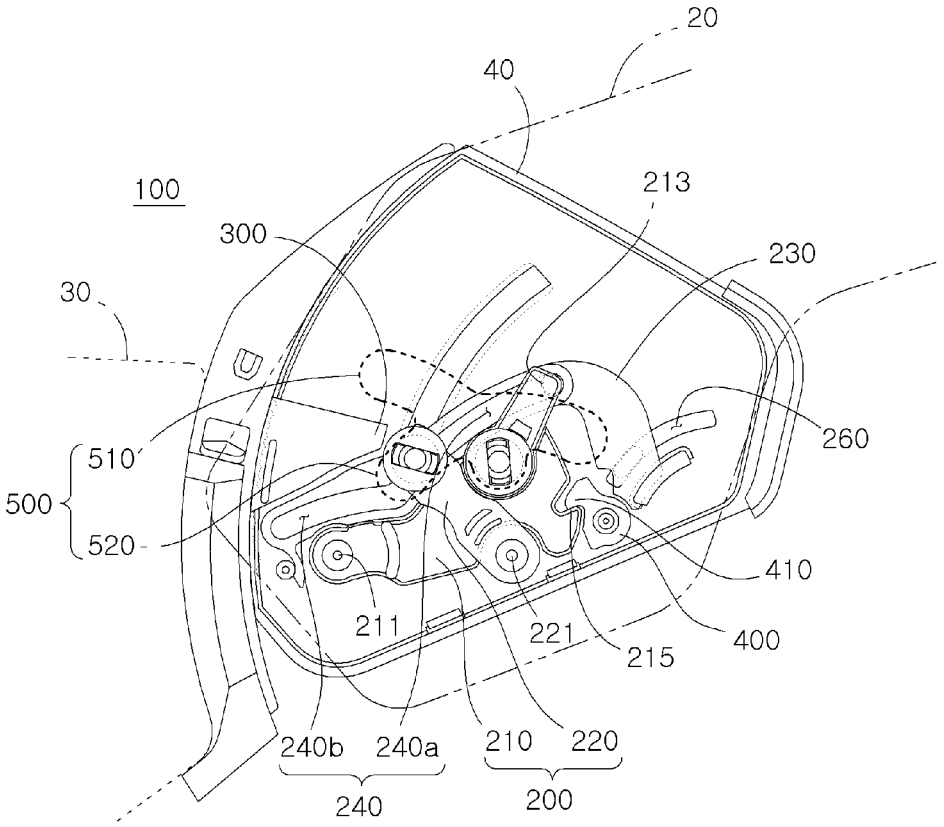

Subsequently, as shown in FIG. 7A, when the chin guard 20 pivots to the second predetermined angle B that is larger than the first and third predetermined angles A, C with respect to the helmet body 10, the shield 30 may pivot downward and the open portion may be closed. That is, when the chin guard 20 pivots to the third predetermined position (Open Face Mode), the shield 30 may pivot to the first position (the closed position of the open portion). In this instance, the second predetermined angle B of the chin guard 20 is not limited to a particular angle, but may be, for example, between 190° and 210°.

However, when the chin guard 20 pivots, the shield 30 does not necessarily pivot, and when the shield 30 pivots downward to close the open portion, the chin guard may pivot to the second predetermined angle B with respect to the helmet body 10. That is, when the shield 30 pivots from the second position (the open position of the open portion) to the first position (the closed position of the open portion), the chin guard 20 may pivot to the third predetermined position (Open Face Mode).

In the end, since the chin guard 20 and the shield 30 pivot in tandem, when the chin guard 20 pivots, the shield 30 pivots, and when the chin guard 20 is in the second predetermined position (Wearing Mode, see FIG. 6A), the shield 30 is in the second position (the open position of the open portion), so it is easy for the wearer to wear the helmet.

Additionally, since the chin guard 20 and the shield 30 pivot in tandem, when the chin guard 20 is disposed above and the shield 30 pivots downward (when the shield 30 pivots from the second position (the open position of the open portion) to the first position (the closed position of the open portion) (see FIGS. 6A to 7A)), the chin guard may automatically pivot to the third predetermined position (Open Face Mode) at the rear of the helmet body 10.

As shown in FIG. 2, the chin guard pivoting mechanism 100 may be included in, for example, the ratchet 40, and basically, may include a link 200 and an arm 230. Specifically, the link 200 may be, at one side, coupled to the chin guard 20, and the arm 230 may, at one side, support the shield 30 to pivot the shield 30. That is, the link 200 may be coupled to the chin guard 20, and the arm 230 may support the shield 30, and in this instance, the link 200 and the arm 230 may pivot in tandem, and accordingly the chin guard 20 and the shield 30 may pivot in tandem.

More specifically, the link 200 may include a first link 210 and a second link 220. Here, the end of the chin guard 20 is coupled to one side of the first link 210 and one side of the second link 220 at the same time. For example, when one side of the first link 210 and one side of the second link 220 are coupled to a connection portion 250 having two connection holes 253, one side of the first link 210 and one side of the second link 220 may be connected to each other. Additionally, when the connection portion 250 is coupled to a fixing portion 25 at the end of the chin guard 20, as a result, one side of the first link 210 and one side of the second link 220 may be coupled to the chin guard 20 at the same time.

On the other hand, the other side of the first link 210 pivots around a first rotation axis 211 of the ratchet 40, and the other side of the second link 220 pivots around a second rotation axis 221 (different from the first rotation axis 211) of the ratchet 40. In this instance, since one side of the first link 210 and one side of the second link 220 are coupled to the end of the chin guard 20 at the same time, when the chin guard 20 pivots, the first link 210 and the second link 220 may pivot in tandem.

Additionally, the arm 230 may have, on one surface, a sliding portion 240 recessed along the lengthwise direction, and a coupling portion 213 that protrudes from the end of the first link 210 may be inserted into the sliding portion 240 of the arm 230 and slide along the sliding portion 240. Specifically, when the chin guard 20 pivots, the first link 210 may pivot around the first rotation axis 211, and the coupling portion 213 of the first link 210 may slide along the sliding portion 240. More specifically, the sliding portion 240 may include a first sliding portion 240*a* and a second sliding portion 240*b*. Here, the first sliding portion 240*a* is extended in an arc shape, and the second sliding portion 240*b* is extended from the end of the first sliding portion 240*a* in an arc shape. In this instance, the center of the arc of the first sliding portion 240*a* and the center of the arc of the second sliding portion 240*b* are different from each other. Accordingly, a point at which the first sliding portion 240*a* and the second sliding portion 240*b* meet may have a bent shape. In the end, when the chin guard 20 pivots, the coupling portion 213 of the first link 210 may slide along the first sliding portion 240*a*, then slide along the second sliding portion 240*b*, and finally, slide along the first sliding portion 240*a* again.

Meanwhile, a support portion 300 may be disposed above one side of the arm 230. In this instance, the support portion 300 may be coupled to the shield 30 and pivot by the guidance of the ratchet 40. Accordingly, when the arm 230 pivots, the arm 230 may press the support portion 300, and the support portion 300 and the shield 30 may pivot. Additionally, the arm 230 is provided with the other side (different from one side supporting the support portion 300), which is configured to slide along a pivoting portion 260 (disposed in the ratchet 40) extended in an arc shape, such that the arm 230 rotates as the other side slides in the pivoting portion 260. That is, the arm 230 may pivot in the vertical direction along the pivoting portion 260 extended in an arc shape.

The operation relationship of the first link 210, the second link 220 and the arm 230 will be described in detail below.

As shown in FIGS. 3 and 4, when the chin guard 20 pivots from the front side of the wearer's chin to the first predetermined angle A with respect to the helmet body 10 and the shield 30 pivots upward, the coupling portion 213 of the first link 210 may slide along the first sliding portion 240*a* of the arm 230. Specifically, when the chin guard 20 pivots in one direction (the clockwise direction), the first link 210 and the second link 220 coupled to the chin guard 20 pivot in the other direction (the counterclockwise direction), and as the coupling portion 213 of the first link 210 slides along the first sliding portion 240*a* of the arm 230, the arm 230 pivots in one direction (the clockwise direction), and the shield 30 supported on the arm 230 pivots upward (in one direction). In the end, when the chin guard 20 pivots by the first predetermined angle A from the first predetermined position (Full Face Mode), the shield 30 may pivot from the first position (the closed position of the open portion) to the second position (the open position of the open portion).

Figure 5A:
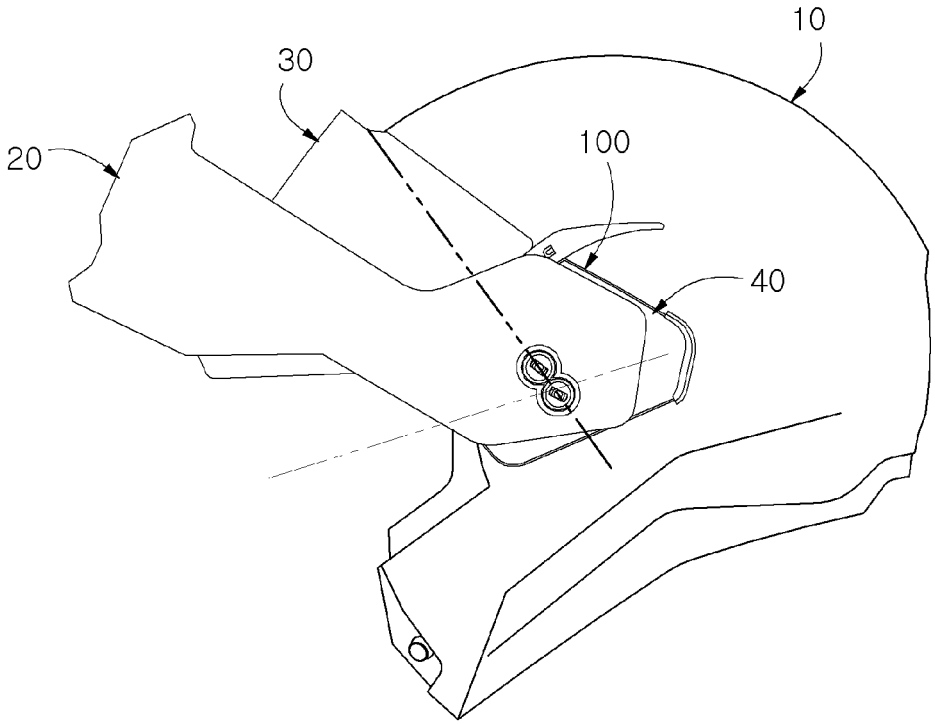
Figure 5B:
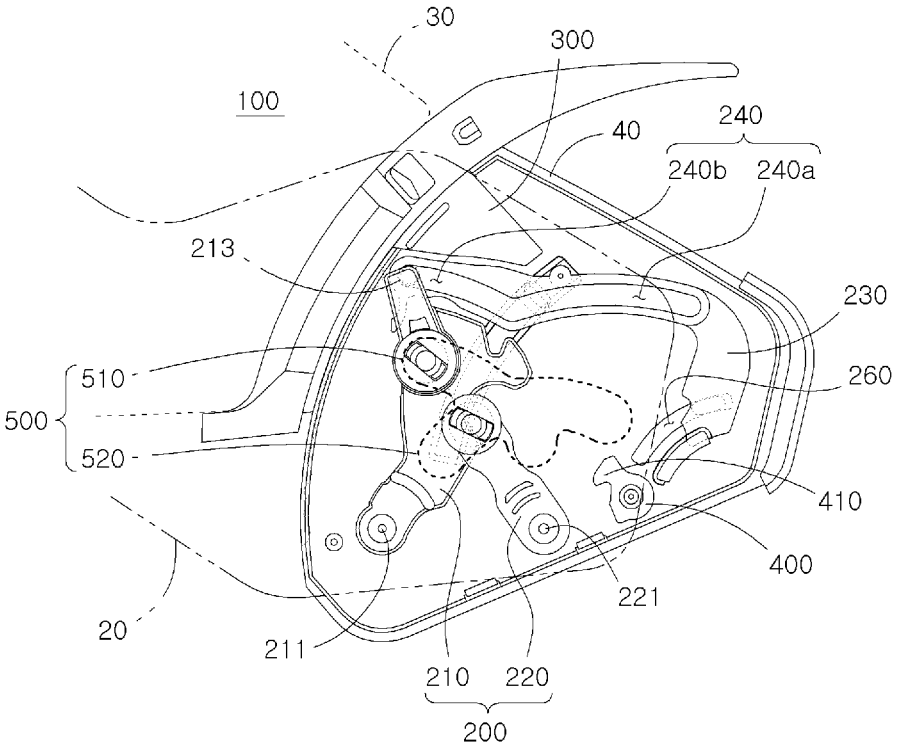
Figure 6B:
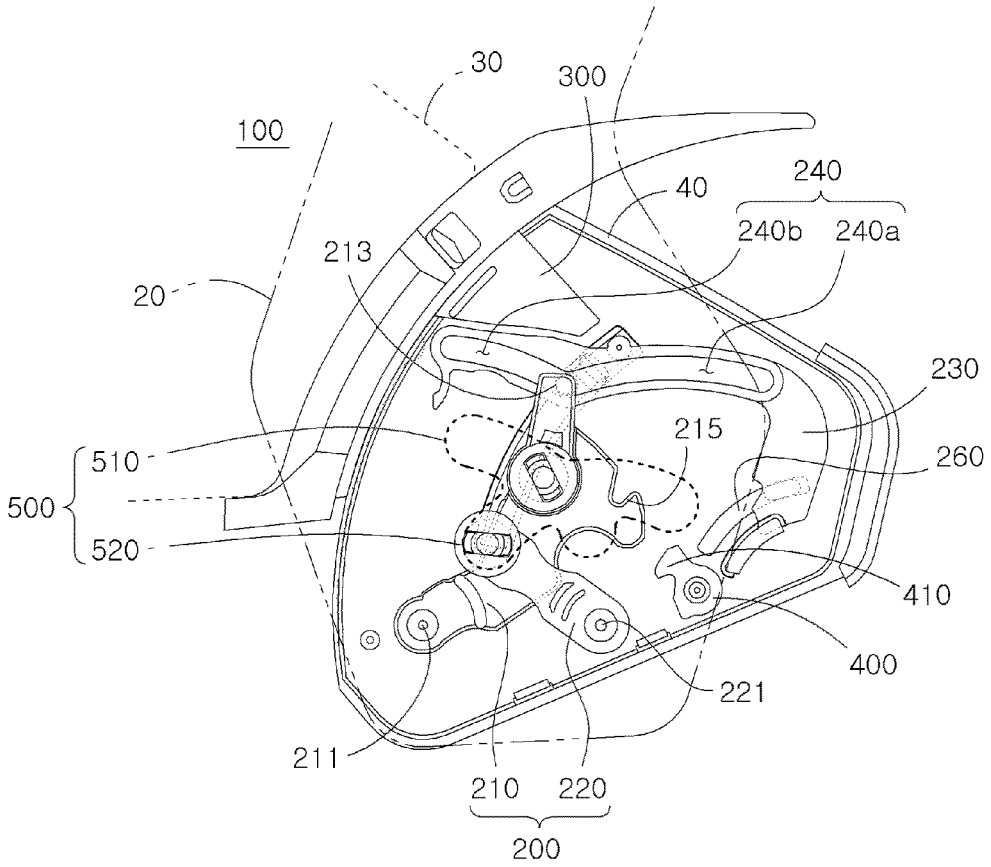

As shown in FIGS. 5 and 6, when the chin guard 20 pivots from the first predetermined angle A to the third predetermined angle C with respect to the helmet body 10 and the shield 30 does not pivot, the coupling portion 213 of the first link 210 may slide along the second sliding portion 240*b* of the arm 230. Specifically, when the chin guard 20 pivots in one direction (the clockwise direction), the first link 210 and the second link 220 coupled to the chin guard 20 pivot in the other direction (the counterclockwise direction), and the coupling portion 213 of the first link 210 slides along the second sliding portion 240*b* of the arm 230 (see FIG. 5B). Subsequently, when the chin guard 20 additionally pivots in one direction (the clockwise direction), the first link 210 and the second link 220 coupled to the chin guard 20 pivot in one direction (the clockwise direction) and the other direction (the counterclockwise direction), respectively, and the coupling portion 213 of the first link 210 slides along the second sliding portion 240*b* of the arm 230 (see FIG. 6B). In the end, the coupling portion 213 of the first link 210 slides from one end (an end connected to the first sliding portion 240*a*) of the second sliding portion 240*b* of the arm 230 to the other end (see FIG. 5B), and then slides from the other end of the second sliding portion 240*b* to one end (see FIG. 6B). In this instance, the radius of curvature of the second sliding portion 240*b* may corresponds to the distance between the coupling portion 213 and the first rotation axis 211. Accordingly, while the coupling portion 213 of the first link 210 moves along the two ends of the second sliding portion 240*b*, the arm 230 does not pivot, and accordingly the shield 30 supported on the arm 230 does not pivot, either. In the end, while the chin guard 20 pivots to the second predetermined position (Wearing Mode), the shield 30 may be kept in the second position (the open position of the open portion).

As shown in FIG. 7, when the chin guard 20 pivots from the third predetermined angle C to the second predetermined angle B with respect to the helmet body 10 and the shield 30 pivots downward, the coupling portion 213 of the first link 210 may slide along the first sliding portion 240*a* of the arm 230. Specifically, when the chin guard 20 pivots in one direction (the clockwise direction), the first link 210 and the second link 220 coupled to the chin guard 20 pivot in one direction (the clockwise direction) (in this instance, a pivot angle of the second link 220 is smaller than that of the first link 210), and as the coupling portion 213 of the first link 210 slides along the first sliding portion 240*a* of the arm 230, the arm 230 pivots in the other direction (the counterclockwise direction), and the shield 30 supported on the arm 230 pivots downward (in the other direction). In the end, when the chin guard 20 pivots from the second predetermined position (Wearing Mode) to the third predetermined position (Open Face Mode), the shield 30 may pivot to the first position (the closed position of the open portion).

However, the present disclosure is not necessarily limited to the downward pivoting of the shield 30 with the pivoting of the chin guard 20, and may include pivoting of the chin guard 20 with the downward pivoting of the shield 30. That is, when the shield 30 pivots downward and the chin guard 20 pivots to the second predetermined angle B with respect to the helmet body 10, the coupling portion 213 of the first link 210 may slide along the first sliding portion 240*a* of the arm 230. Specifically, when the shield 30 pivots in the other direction (the counterclockwise direction), the arm 230 supporting the shield 30 pivots in the other direction (the counterclockwise direction), and as the coupling portion 213 of the first link 210 slides along the first sliding portion 240*a* of the arm 230, the first link 210 and the second link 220 pivot in one direction (the clockwise direction), and accordingly the chin guard 20 coupled to the first link 210 and the second link 220 may pivot in one direction (the clockwise direction). In the end, when the shield 30 pivots from the second position (the open position of the open portion) to the first position (the closed position of the open portion), the chin guard 20 may pivot from the second predetermined position (Wearing Mode) to the third predetermined position (Open Face Mode).

Overall, one side of the first link 210 and one side of the second link 220 coupled to the chin guard 20 are reversed by the pivoting of the chin guard 20. Specifically, when the chin guard 20 pivots from the front side of the wearer's chin with respect to the helmet body 10, one side of the first link 210 may be disposed in front of one side of the second link 220 (see FIGS. 3B and 4B), then disposed above one side of the second link 220 (see FIGS. 5B and 6B), and subsequently, disposed at the rear of one side of the second link 220 (see FIG. 7B).

Meanwhile, to guide the movement path of one side of the first link 210 and one side of the second link 220, the ratchet 40 may have a guide hole 500 on the front surface. Specifically, the guide hole 500 may include a first guide hole 510 and a second guide hole 520. Here, the first guide hole 510 plays a role in guiding the movement path of one side of the first link 210, and the second guide hole 520 plays a role in guiding the movement path of one side of the second link 220. Accordingly, the radius of curvature of the first guide hole 510 may correspond to the distance between one side of the first link 210 and the first rotation axis 211, and the radius of curvature of the second guide hole 520 may correspond to the distance between one side of the second link 220 and the second rotation axis 221.

In addition, the ratchet 40 may include a fastening portion 400 to fix the link 200. Here, when the chin guard 20 is disposed in front of the wearer's chin or at the rear of the helmet body 10, the fastening portion 400 may be coupled to the link 200 (the first link 210) to prevent arbitrary pivoting of the link 200 (the first link 210). Accordingly, it is possible to prevent arbitrary pivoting of the chin guard 20 coupled to the link 200 (the first link 210) by the fastening portion 400. However, when the wearer manipulates the chin guard 20 to pivot the chin guard 20 with respect to the helmet body 10, the fastening portion 400 may be separated from the link 200 (the first link 210).

Specifically, when the chin guard 20 is disposed in front of the wearer's chin or at the rear of the helmet body 10, a first hook portion 410 of the fastening portion 400 may be fastened to a second hook portion 215 of the link 200 (the first link 210) to prevent arbitrary pivoting of the link 200 (the first link 210). However, when the wearer manipulates the chin guard 20 to pivot the chin guard 20 with respect to the helmet body 10, the link 200 (the first link 210) may pivot, and accordingly, the fastening portion 400 may pivot, and the first hook portion 410 may be separated from the second hook portion 215. In this instance, an elastic force may be applied to the fastening portion 400 in a direction in which the first hook portion 410 is fastened to the second hook portion 215. For example, a torsion spring may be coupled to the fastening portion 400.

While the present disclosure has been hereinabove described in detail through the specific embodiments, this is provided to describe the present disclosure in detail, and the present disclosure is not limited thereto, and it is obvious that modifications or changes may be made thereto by those having ordinary skill in the art within the technical spirit of the present disclosure.

Such modifications and changes of the present disclosure fall in the scope of the present disclosure, and the scope of protection of the present disclosure will be apparent by the appended claims.

| List of Main Elements | |
|---|---|
| 10: Helmet body | 20: Chin guard |
| 30: Shield | 40: Ratchet |
| 100: Chin guard pivoting mechanism | 200: Link |
| 210: First link | 211: First rotation axis |
| 213: Coupling portion | 215: Second hook portion |
| 220: Second link | 221: Second rotation axis |
| 230: Arm | 240: Sliding portion |
| 240a: First sliding portion | 240b: Second sliding portion |
| 250: Connection portion | 260: Pivoting portion |
| 300: Support portion | 400: Fastening portion |
| 410: First hook portion | 500: Guide hole |
| 510: First guide hole | 520: Second guide hole |

The present disclosure provides the chin guard pivoting mechanism for pivoting the chin guard and the shield in tandem.

The invention claimed is:

1. A chin guard pivoting mechanism configured to couple to-a helmet comprising a helmet body, a chin guard pivotally coupled to the helmet body and a shield pivotally coupled to the helmet body, the chin guard pivoting mechanism comprising:

a link comprising a first link and a second link, wherein the first link comprises a first side and a second side, and the second link comprises a first side and a second side, wherein the first side of the first link is configured to couple to the chin guard and the first side of the second link is configured to couple to the chin guard, and wherein the second side of the first link is configured to pivot around a first rotation axis, and the second side of the second link is configured to pivot around a second rotation axis;

an arm configured to pivot the shield on a first side of the arm, wherein the link and the arm are configured to pivot in tandem; and wherein upon pivoting of the chin guard from a location configured to be on a front side of a wearer's chin to a first predetermined angle with respect to the helmet body, the arm is configured to pivot the shield upward, and upon pivoting of the chin guard to a second predetermined angle which is larger than the first predetermined angle with respect to the helmet body, the arm is configured to pivot the shield downward, or wherein upon pivoting of the chin guard from the location configured to be on the front side of the wearer's chin to the first predetermined angle with respect to the helmet body, the arm is configured to pivot the shield upward, and the arm is configured to pivot the shield downwards, causing the chin guard to pivot to the second predetermined angle with respect to the helmet body.

2. The chin guard pivoting mechanism according to claim 1, wherein upon pivoting of the chin guard from the first predetermined angle to a third predetermined angle between the first predetermined angle and the second predetermined angle with respect to the helmet body, the arm is configured to not pivot the shield.

3. The chin guard pivoting mechanism according to claim 1, wherein upon pivoting of the chin guard from the location configured to be on the front side of the wearer's chin with respect to the helmet body, the first side of the first link is disposed in front of the first side of the second link, then disposed above the first side of the second link, and subsequently disposed behind the first side of the second link.

4. The chin guard pivoting mechanism according to claim 1, wherein the arm has a sliding portion being formed in a lengthwise direction of the arm, and wherein upon the pivoting of the chin guard, a coupling portion of the first link is slidable along the sliding portion.

5. The chin guard pivoting mechanism according to claim 4, wherein the sliding portion includes:

a first sliding portion extended in an arc shape; and a second sliding portion extended from an end of the first sliding portion in an arc shape.

6. The chin guard pivoting mechanism according to claim 5, wherein the coupling portion slides along the first sliding portion when the arm pivots the shield upward, and wherein the coupling portion slides along the first sliding portion when the arm pivots the shield downward.

7. The chin guard pivoting mechanism according to claim 6, wherein upon pivoting of the chin guard from the first predetermined angle to a third predetermined angle between the first predetermined angle and the second predetermined angle with respect to the helmet body, and not pivoting of the shield, the coupling portion slides along the second sliding portion.

8. The chin guard pivoting mechanism according to claim 7, wherein a radius of curvature of the second sliding portion corresponds to a distance between the coupling portion and the first rotation axis.

9. The chin guard pivoting mechanism according to claim 1, wherein a second side of the arm comprises a sliding portion that is configured to slide along a pivoting portion extended in an arc shape, such that the arm rotates as the sliding portion of the arm slides in the pivoting portion.

10. The chin guard pivoting mechanism according to claim 1, further comprising a fastening portion which is coupled to the link, and is separated from the link upon the pivoting of the chin guard with respect to the helmet body.

11. The chin guard pivoting mechanism according to claim 10, wherein a first hook portion of the fastening portion is fastened to a second hook portion of the link, and upon the pivoting of the chin guard with respect to the helmet body, the link pivots and accordingly the fastening portion pivots, and the first hook portion is separated from the second hook portion.

12. The chin guard pivoting mechanism according to claim 11, wherein the fastening portion is configured to receive an elastic force to rotate the fastening portion such that the first hook portion becomes fastened to the second hook portion.

* * * * *